United States Patent [19]

Bigelow et al.

[11] 4,176,715

[45] Dec. 4, 1979

[54] HIGH TEMPERATURE WELL PACKER

[75] Inventors: Eugene H. Bigelow, Long Beach; Burton J. Goldsmith, Redondo Beach, both of Calif.

[73] Assignee: Baker International Corporation, Orange, Calif.

[21] Appl. No.: 863,871

[22] Filed: Dec. 23, 1977

[51] Int. Cl.[2] ..... E21B 33/129

[52] U.S. Cl. ..... 166/138; 166/140

[58] Field of Search ..... 166/138, 139, 140, 118, 166/119, 123, 134, 216, 217

[56] References Cited

U.S. PATENT DOCUMENTS

| | | | |
|---|---|---|---|
| 3,136,365 | 6/1964 | Carter et al. | 166/139 X |
| 3,189,096 | 6/1965 | Phenix | 166/138 X |
| 3,256,437 | 6/1966 | Muse | 166/139 |
| 3,289,766 | 12/1966 | Bigelow | 166/139 |

*Primary Examiner*—Stephen J. Novosad
*Attorney, Agent, or Firm*—Subkow and Kriegel

[57] ABSTRACT

A well packer has a casing engaging slip mechanism and a packing element carried on a tubular body which is released from the slip assembly enabling setting of the slips and packing by an upward pull on a running in string of pipe. The body and the expander for the slips are locked to hold the packer set. A length of tubing extends through a seal in the body and is released to be slideable in the body enabling temperatue change responsive elongation and contraction of the running pipe, without affecting the packer. A shearable release enables retrieval of the packer assembly by pulling on the running pipe. An emergency release of the running pipe is accomplished by releasing a guide on the end of the slideable tubing.

Well bore packers are frequently used in well casings, with a tubular string of running and retrieving pipe or tubing associated with the packer and held in tension. In the presence of high temperatures, the resultant expansion of the tubing tends to relieve the tubing tension. Temperature variations not only affect the components of the packer assembly but can also cause contraction of the tubing, as well as expansion.

In U.S. Pat. No. 3,256,437, granted June 14, 1966, for "High Temperature Well Packer Apparatus" there is disclosed a packer assembly which is especially adapted or well suited to be used in high temperature well bores, say having temperatures on the order of 400° F. to 700° F. One feature of that prior packer which enables its use in high temperature wells is that a sealed tubing member or "slick" joint extends through the body of the packer and can be released from the body to allow for expansion and contraction of the tubing string. The packing and slick joint seal can be periodically re-tightened to prevent leakage, and the packer assembly is retrievable.

20 Claims, 11 Drawing Figures

HIGH TEMPERATURE WELL PACKER

Figure 1A:
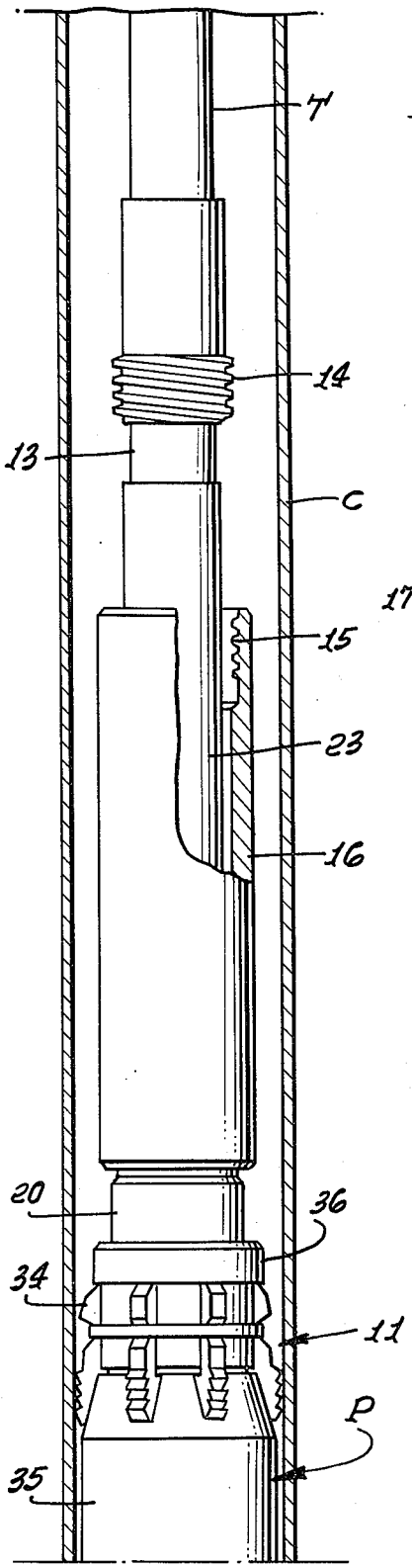

The present invention relates to improvements in well bore packers adapted to be set in a well casing in response to a tension or upstrain applied to a running pipe or tubing and adapted to be retrieved by pullng on the running pipe string, the packer assembly being particularly well suited for use in a high temperature well where it is subjected to temperature variations as well as high temperature.

More particularly, the invention combines features of the aforesaid patent with other structural characteristics to provide an improved high temperature packer which is set in the well casing and retrieved therefrom by taking a pull on the tubing string, but without requiring rotation of the tubing string except to release a control device when the packer is initially set in the well bore and to release a connection between the packer body and the tubing to allow the tubing to be spaced out.

Once set, the packer has a body locking structure which obviates the necessity of subsequent tightening of the packing element to prevent leakage. This is accomplished by locking the packer body and the anchor slip expander cone against movement of the cone from beneath the anchor slips, notwithstanding expansion and contraction due to heat variations. However, the body can be pulled upwardly relative to the cone through the lock upon the shearing of a shearable member which maintains the compressive load on the resilient packing element.

Furthermore, in the event that even after applying a pull to the tubing string, the packing structure does not release, the tubing string can be released from the packing structure and retrieved from the well. This is accomplished by providing a guide on the lower end of the slick joint which can be engaged with the packer body and removed from the slick joint by rotation of the tubing string, thus enabling the slick joint to be pulled upwardly from the packer body.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Figure 1B:
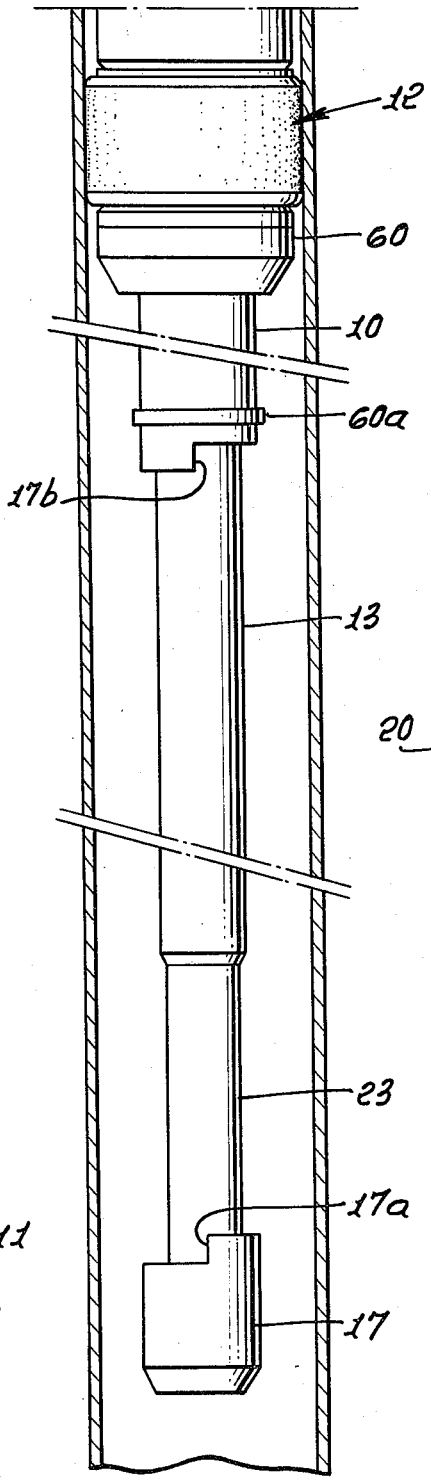

Referring to the drawings:

FIGS. 1*a* and 1*b*, together, constitute a view in elevation with a fragmentary longitudinal section, illustrating a packer assembly made in accordance with the invention and set in a well bore casing with the tubing spaced out, FIG. 1*b* being a downward continuation of FIG. 1*a;*

Figure 2A:
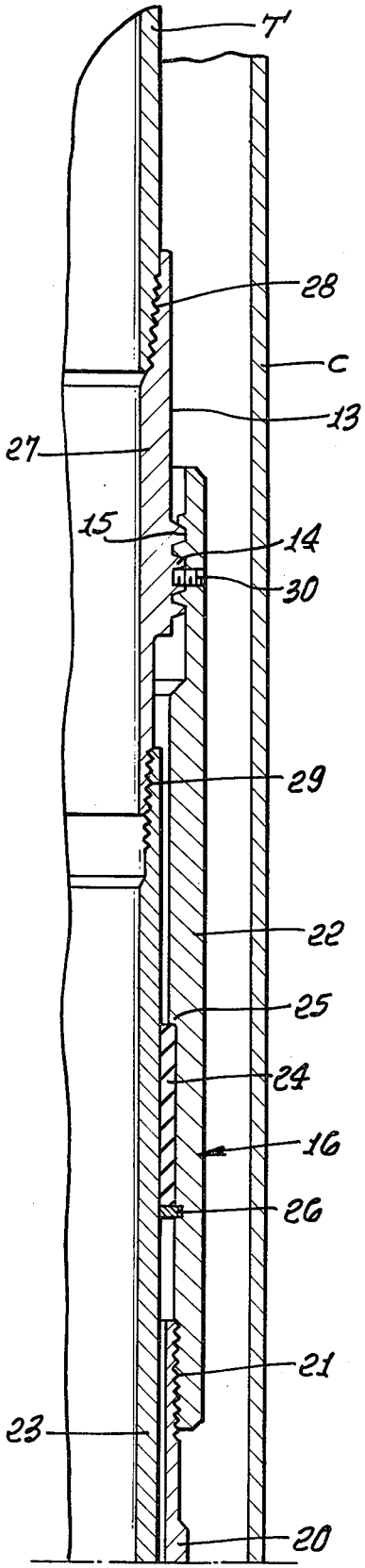
Figure 2B:
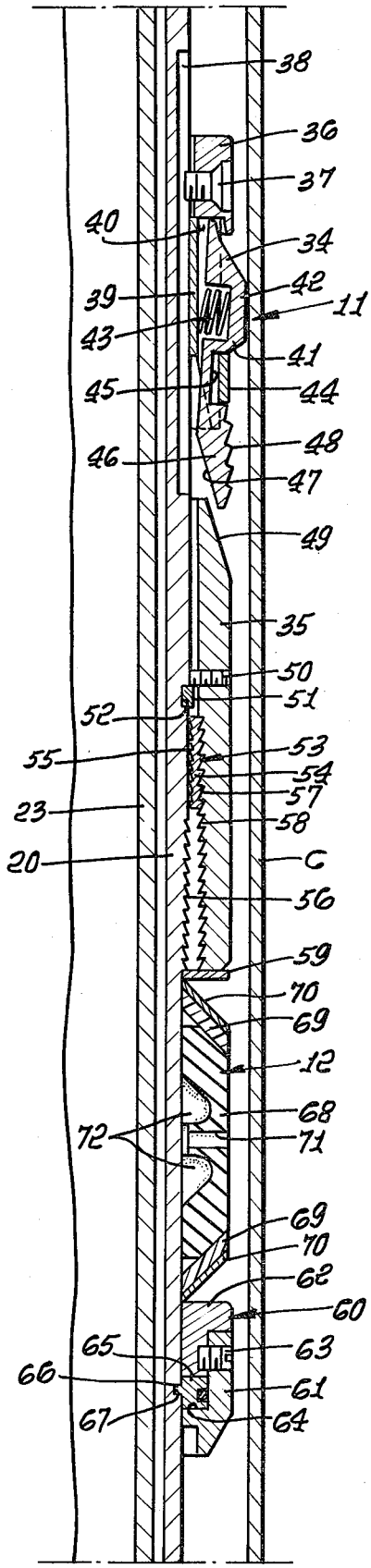
Figure 2C:
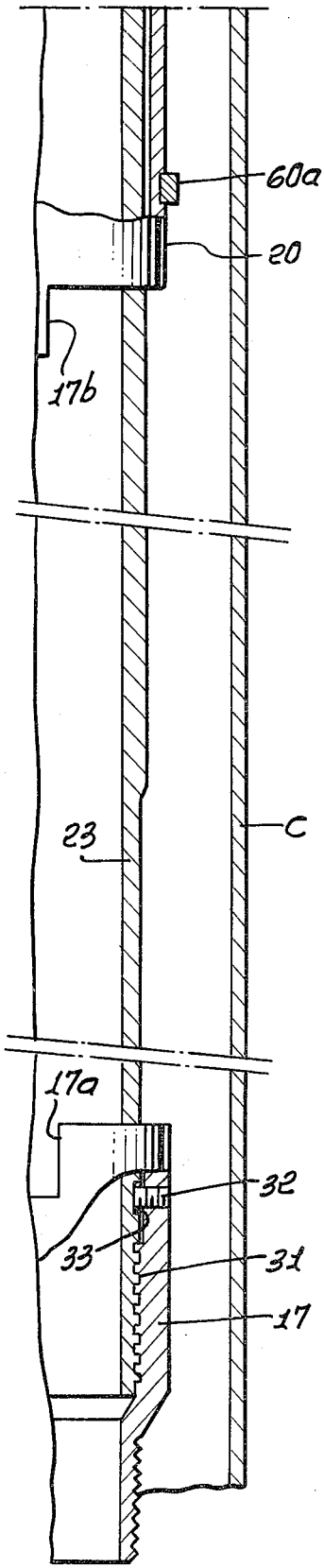

FIGS. 2*a*, *2b*, and 2*c*, together, constitute a longitudinal quarter section illustrating the packer assembly of FIGS. 1*a* and 1*b* in condition for running into the well casing, FIGS. 2*b* and 2*c* being successive downward continuations of FIG. 2*a;*

Figure 3A:
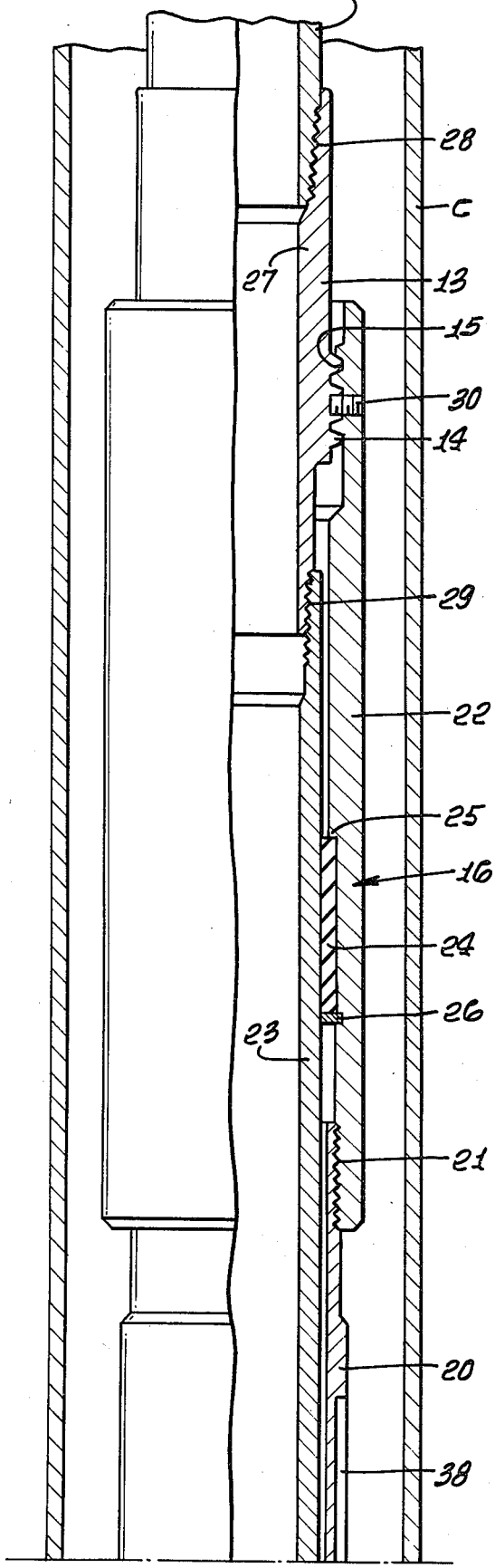
Figure 3B:
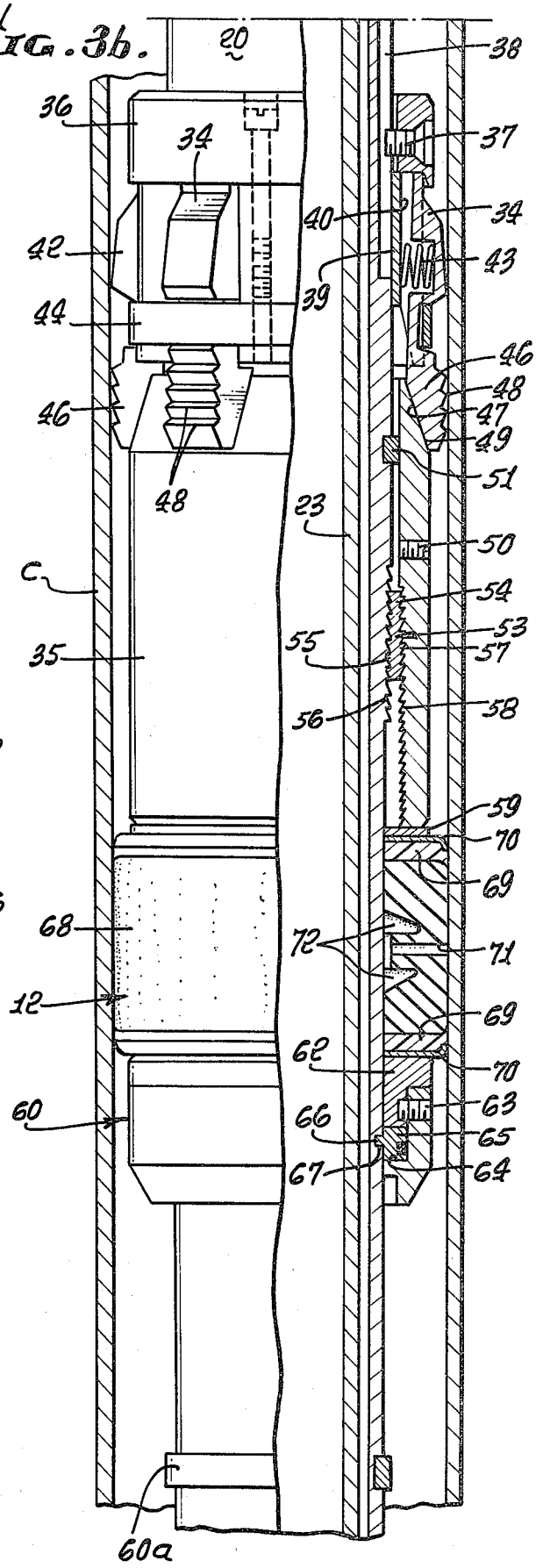

FIGS. 3*a* and 3*b*, together, constitue a view partly in longitudinal section and partly in elevation, showing the packer assembly in anchored and set condition in the well casing, FIG. 3*b* being a downward continuation of FIG. 3*a;*

Figure 4A:
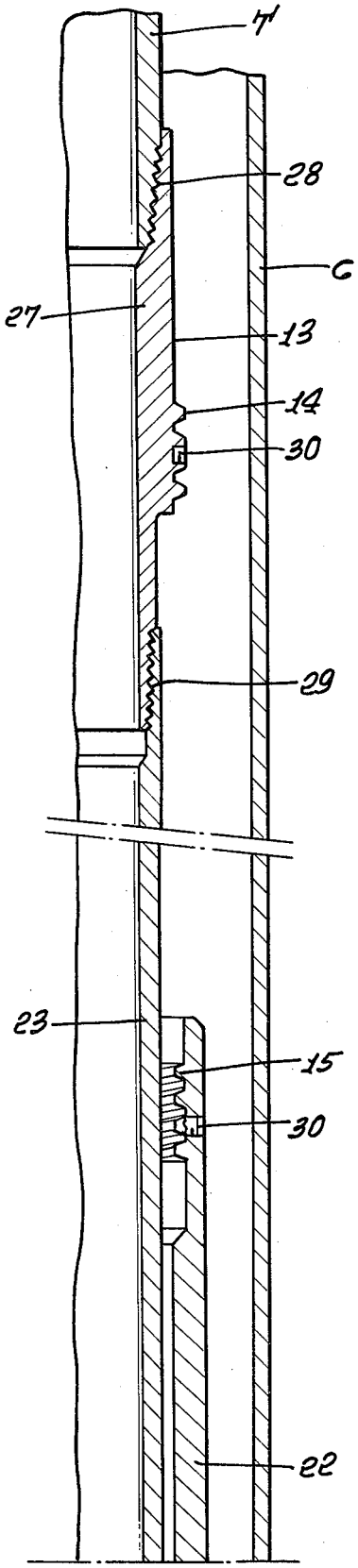
Figure 4B:
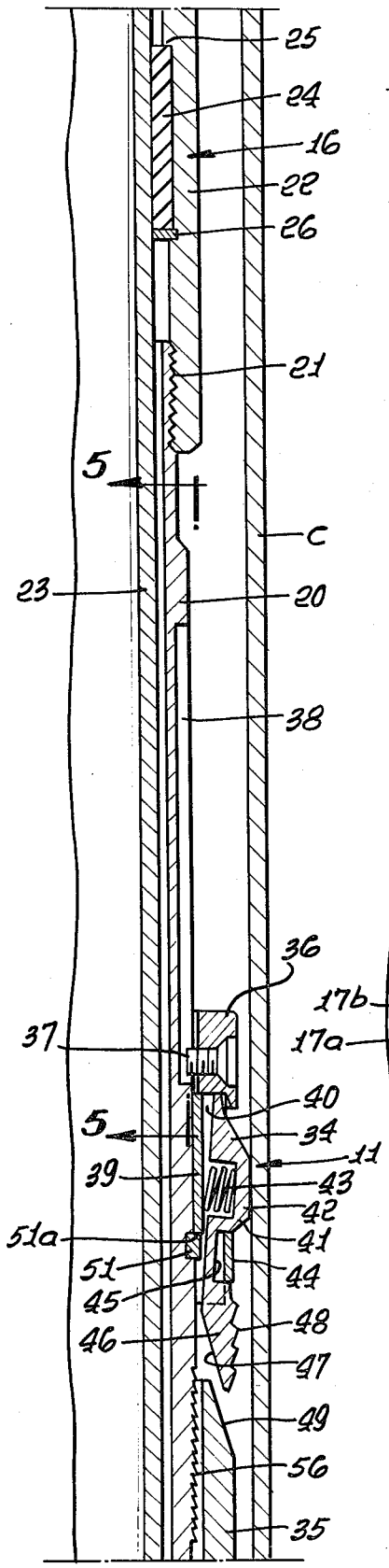
Figure 4C:
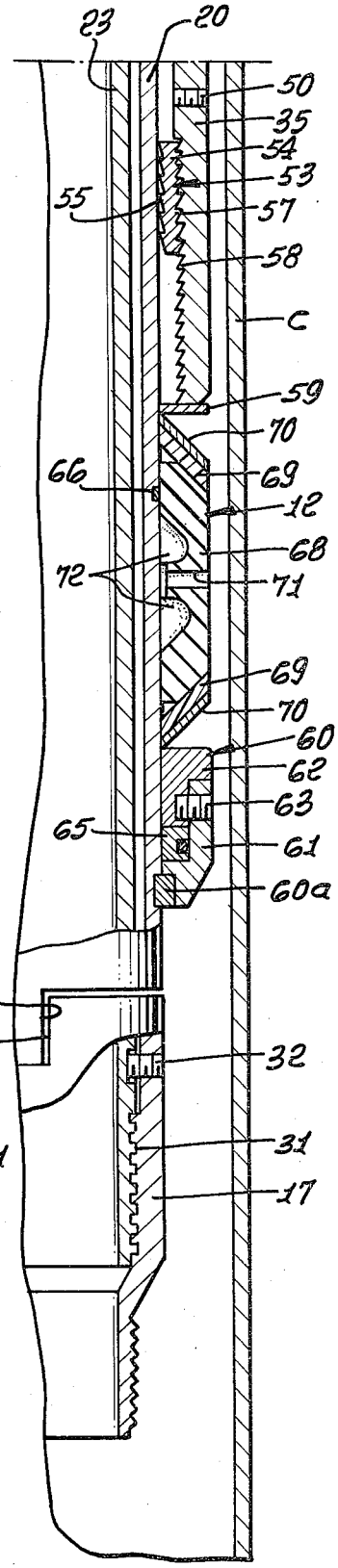

FIGS. 4*a*, 4*b*, and 4*c*, together, constitute a longitudinal quarter sections illustrating the packer assembly released for retrieval from the well casing, FIGS. 4*b* and 4*c* being successive downward continuation of FIG. 4*a;*

Figure 5:
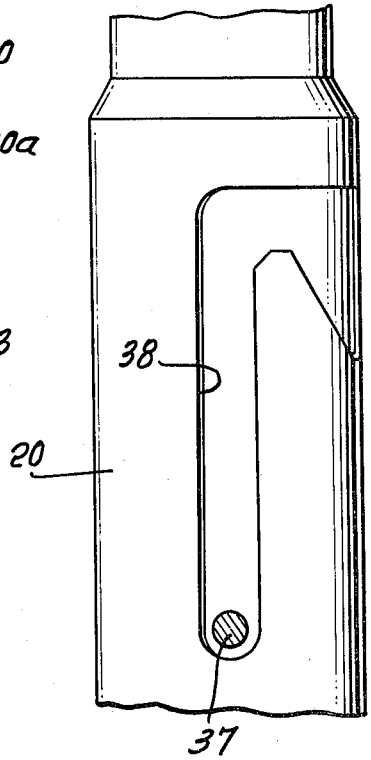

FIG. 5 is a fragmentary view as taken on the line 5—5 of FIG. 4*b*, illustrating the control slot for the packer.

As seen in the drawings, referring first to FIGS. 1*a* and 1*b*, the invention provides a packer assembly P adapted to be connected to a length of running pipe or tubing T to be run into a well bore casing C set in a well, such as a fluid injection or production well, drilled into the earth. The packer assembly includes an elongated inner body 10 having thereon casing engaging normally retracted, but laterally expansible anchor means 11 and a resiliently deformable packing element 12 adapted to be set in sealing engagement within the casing C. When the packing assembly is set in the casing, an internal, elongated tubular member or slick joint 13 extends reciprocably through the packer assembly, being initially releasably connected to the packer body by means of a left-hand thread 14 on the slick joint and an internal companion thread 15 within the upper end of a tubular body member 16. When the slick joint is released from the packer body, the tubing is free for expansion and contraction caused by temperature changes within the well, without applying load to the packer assembly. At the lower end of the slick joint 13 is a guide nose 17 which, in some installations, may have a downwardly extended length of tubing (not shown) connected thereto for extending further downwardly in the well bore.

The packer assembly is adapted to be run into the well bore with the anchor means 11 retracted and with the packing element 12 released for freedom of movement of the assembly downwardly through the well casing. When the packer assembly is disposed at a predetermined location in the well casing, it is adapted to be anchored and set upon release of the body control means to be hereinafter described, by simply taking tension upon the running in pipe or tubing T, thereby causing the anchor means 11 to be expanded into anchoring engagement with the casing and then causing deformation and expansion of the packing element 12 into sealing engagement with the casing. Release of the packer assembly for retrieval from the well is also accomplished by simply taking further tension on the running pipe string T to release the packing element 12 from sealing engagement with the casing and then causing release of the anchor means 11. In the event that the packing assembly cannot be readily released from anchoring engagement with the well casing, the guide nose 17, as will be later described, can be released from the lower end of the slick joint, allowing the slick joint and tubing to be pulled from the well.

Referring to FIGS. 2*a* through 2*c*, the packer structure is shown in condition to be run into the well casing C on the tubing string T. The body structure 16 includes an elongated tubular body member 20 having at its upper end a threaded connection 21 with a further upwardly extended sealing nipple 22 having the internal left-hand thread 15 referred to above, adjacent its upper end. The slick joint structure 13 includes an elongated tubular sealing body 23 extending longitudinally within the sealing nipple 22 and sealingly engaged within an internal packing 24 carried within the sealing nipple 22 between a downwardly facing shoulder 25 and a lower retainer ring 26 carried within the sealing nipple. At its upper end, the tubular slick joint member 23 has a connector sleeve 27 threadedly connected at its upper end, at 28, to the running or tubing string T and at its lower end threadedly connected at 29 to the downwardly extended slick joint member 23, which extends from the lower end of the tubular packer body 20, as seen in FIG. 2c. The left-hand threaded connection 14, 15, between the sealing nipple 22 and the slick joint connector 27 is initially locked against release by suitable means such as a shear screw or pin 30. At its lower end, the tubular slick joint member 23 has the guide nose 17 threadedly connected thereto at 31, the threaded connection being initially locked by a suitable, shearable member or screw 32 threadedly carried by the guide 17 and extending into a recess 33 in the outer periphery of the slick joint member 23.

The anchor means 11 comprises a rocking slip and drag block assembly 34 and a cone or expander member 35 carried by the body 20. The rocking slip and drag block assembly includes a stop ring 36 disposed about the body and having a radially inwardly projecting control pin or screw 37 extending into an inverted J-slot 38 formed within the body 20 (see FIG. 5). Extending downwardly from the stop ring 36 is a slip carrier ring or sleeve 39 having a number of circumferentially spaced radially opening slots 40 in which are rockably disposed slip and drag block members 41 having drag portions 42 normally forced outwardly by a coiled spring 43 disposed between the drag portion 42 and the carrier ring 39 at the bottom of the slot 40, the drag member 42 being retained in the slot by a retainer ring 44 extended about the rocking slip and drag members and received within an outwardly opening slot 45 in the latter. Extending downwardly from the drag portion 42 of each rocking slip and drag member is a slip section 46 having an inner, downwardly, and outwardly inclined wedge surface 47 and having outer, upwardly facing wickers or anchor teeth 48, which are adapted to be expanded into biting or anchoring engagement within the casing C by a downwardly and outwardly inclined upper end surface 49 provided on the expander cone member 35. This expander member 35 is disposed about the packer body 20 and has one or more shear pins or screws 50 carried thereby and projecting inwardly towards the body above a slip pickup ring 51 which extends circumferentially of the body and is disposed in an annular groove 52 therein.

The expander cone member 35 is a tubular member having therein body locking means generally indicated at 53, whereby during setting of the packer assembly in the well casing, as will be later described, the body 20 can be moved upwardly with respect to the expander cone 35 and will be locked in the upwardly shifted position after the anchor slips have been set and the packing element 12 has been deformed into sealing engagement with the casing. Such a body locking means is more particularly the subject of the prior United States patent granted to J. R. Baker et al., on Aug. 4, 1953, U.S. Pat. No. 2,647,584. This body locking means comprises a longitudinally split, resilient lock ring or sleeve 54 carried by the cone member 35 and having internal ratchet teeth 55 engageable with external ratchet teeth 56 on the packer body 20, when, as will be later described, the body is moved upwardly through the lock ring 54, during setting of the packer. As indicated above, the packer is set by upward movement of the body 20. Such relative movement can occur without interference since the internal ratchet teeth 55 on the lock sleeve merely ratchet over the corresponding ratchet teeth or roughened surface 56 of the body, without substantial resistance to its movement. However, any tendency of the body to move downwardly with respect to the cone is prevented by the locking engagement of the internal teeth of the lock sleeve with the roughened surface or teeth of the body. In effect, the ring or sleeve 54 operates as a one-way coupling or clutch element permitting relative movement of the body upwardly, but precluding downward movement. Any tendency of the ring 54 to move downwardly within the cone is resisted by wedging of the tapered cam surfaces of its outer teeth 57 with the companion cam surfaces or teeth 58 within the expander member 35. These opposing teeth 57 and 58 form inclined surfaces of the buttress type threads on the lock ring and in the expander member, and the wedging action of these surfaces urges the lock ring 54 inwardly into the body 20 with greater force when the body tends to move downwardly.

The packing element 12 is disposed about the body 20 below the expander cone member 35, between an upper spacer ring 59 and a lower guide assembly 60. The guide assembly 60 includes a lower member or sleeve 61 and an upper member 62 threadedly interconnected by suitable screws 63 to define an internal annular groove 64 which receives a shear ring or shear ring segments 65 having an internal projection 66 extending into an annular groove 67 in the outer periphery of the body. The packing element 12 is adapted to be set in sealing engagement with the well casing, when, in response to upward movement of the body 20, the guide 60 is moved upwardly toward the spacer ring 59. The packing element 12 includes a central annular body section 68 composed of elastomeric or resiliently deformable material having upper and lower plastic or "TEFLON" backup rings 69 and metallic backup or anti-extrusion rings 70 all of which are deformed as the guide 60 moves upwardly towards the spacer ring 59 to axially deform and circumferentially outwardly expand the resilient packing element. The specific form of the packing element is not germane to the present invention, but the elastomeric element illustrated at 68 is one which has a suitable number of radial ports 71 formed therein, whereby fluid pressure from within the casing can find access to annular chambers 72 formed within the packing element, such pressure acting on the element to effect a tighter seal within the casing, when the packing is set, as will be later described.

Referring to FIGS. 3a and 3b, the packer assembly is shown as having been anchored and set within the well bore. When the packer assembly is lowered within the casing on the tubing T to the location at which the packer is to be set, the tubing string is rotated to the left to release the control mechanism or J-lock 37, 38, to enable continued upward movement of the body 20 with respect to the slip mechanism. The slip mechanism remains stationary within the casing C by virtue of the frictional engagement of the drag sections 42 of the rocking slip structures, while the expander cone 35 is moved upwardly by the thrust imparted thereto from the guide structure 60, through the retracted packing element 12. As the expander surface 49 of the upper end of the cone engages with the inclined surfaces 47 of the slip elements 46, the slips are rocked outwardly into engagement with the casing C, to resist upward movement of the cone 35 and the packing element 12. Continued upward movement of the body 20, then more tightly anchors the slips in engagement with the casing, as the body ratchets upwardly through the lock ring 54 and the packing element 12 is progressively deformed to the condition shown in FIG. 3*b* at which the packing is fully deformed and the slips fully anchored. In order to assure that the slips are first anchored tightly in engagement with the casing, before deformation of the packing element 12, the cone 35 carries one or a plurality of the shearable members 50, referred to above, which after anchoring engagement of the slips with the casing are sheared to permit the packing element 12 to then be deformed.

At this time, the left-handed threaded connection 14, 15, between the slip joint connector member 27 and the sealing nipple 22, can be released by rotation of the tubing T, causing the initial locking screws 30 to be sheared and enabling the release of the threaded connection. The tubing T can then be elevated to the position shown in FIGS. 1*a* and 1*b* so that the slick joint tube 23 is more or less shiftably disposed within the set packer structure with the packing means 24 forming a seal between the slick joint and the interior of the packer body, to prevent the flow of fluid therebetween, with the deformed packing element 12 sealingly engaged with the casing C to prevent the passage of fluid along the outside of the body. Changes in temperature in the well, which can cause expansion and contraction of the tubing string T, under the circumstances just described, have no effect on the holding and sealing effect of the packer structure.

Referring to FIG. 3*b*, it will be noted that when the packer assembly is set and anchored in the well bore, the body lock means 53 releasably holds the slip elements expanded by the expander cone and the packing element deformed between the axially spaced and fixed stops provided by the slips, at the upper end, anchoring against the casing, and by the shearable or frangible end sections 66 of the shear ring or segments 65, engaging with the body at the lower end. Accordingly, when it is desired that the packing assembly be released for retrieval from the well casing, as seen in FIGS. 4*a* through 4*c*, it is only necessary to take a further upstrain or tension on the tubing string T sufficient to cause the shearing of the projections 66 from the shear ring or segments 65, as seen in FIG. 4*c*. When this is done, the holding force is relieved from the resilient packing element, as the guide member 60 is allowed to move downwardly along the body, such downward movement being arrested by a pickup ring 60*a* provided in the outer periphery of the packer body adjacent its lower end. In addition, as seen in FIG. 4*b*, the pickup ring 51 carried by the packer body above the body lock means 53, shoulders at 51*a* with the lower, inner end of the slip support ring 39, so that the slips are pulled upwardly with respect to the cone 35, and the packer assembly can then be moved vertically from the well casing.

It may sometimes occur that the slip or anchoring structure is incapable of release due to accumulation of debris or sediment, or due to corrosion, and the like, in which case it is nevertheless desirable to be able to retrieve from the well bore the tubing string extended between the top of the well and the stuck packer.

Referring to FIGS. 2*a* and 4*c*, it will be seen that the lower guide 17, at the lower end of the slick joint 23 and the lower end of the packer body 20 have cooperative clutch means which enable the guide to be held against rotation while the tubing string T is rotated, so that the left-hand thread 31 can be disconnected between the guide 17 and the slick joint, following shearing of the screw 32. To accomplish this, it is simply necessary to elevate the tubing string to bring into opposing relation longitudinally extended opposed ends 17*a* on the guide 17 and 17*b* on the lower end of the body, followed by rotation of the tubing string to the right and the guide 17 will be progressively threaded downwardly from the lower end of the slick joint. The guide 17 will remain in the well together with any tailpipe which may be suspended therefrom, but the tubing string can then be retrieved from the well bore with the slick joint secured thereto.

From the foregoing, it will be apparent that the present invention provides a novel packer structure which is easy to operate, in that it can be set in response to simple longitudinal strain on a running string of pipe and then retrieved by the application of further longitudinal pull to the running string. The resilient body lock permits the necessary longitudinal motion to occur, as the packer is being set and released, and also provides means, in combination with the shearable elements 66 on the shear ring or segments 65, to retain the packer in effective packed off condition within the well casing.

I claim:

1. A well bore packing adapted to be set in a casing in a well, comprising: an elongated body, normally retracted slip means on said body, expander means on said body for expanding said slip means, control means releasably connecting one of said slip means and expander means to said body and enabling expansion of said slip means by said expander means in response to longitudinal movement of said body following release of said control means, an abutment on said body, a resiliently deformable packing between said abutment and the other of said slip means and expander means to be resiliently deformed into sealing engagement with said body in response to further longitudinal movement of said body following expansion of said slip means, one way locking means enabling said further longitudinal movement of said body and for holding said body shifted with said packing deformed and said slip means engaged with the casing, release means releasably connecting said abutment to said body for permitting relaxation of said packing upon release of said release means, said release means being releasable upon additional longitudinal movement of said body, and means for connecting said body to a pipe string for running and retrieving said packer.

2. A well bore packer as defined in claim 1; said means for connecting said body to a pipe including a tubular member telescopically engaged in said body, means forming a seal between said body and said tubular member, and means connecting said tubular member to said body and releasable by manipulation of said pipe string.

3. A well bore packer as defined in claim 1; said locking means being between said body and said expander means.

4. A well bore packer as defined in claim 1; said locking means being between said body and said expander means, said control means being between said slip means and said body.

5. A well bore packer as defined in claim 1; said slip means including elements having friction drag portions and wickered portions, and means for rockably supporting said elements with said drag portions engaged with said casing and said wickered portions expansible into gripping engagement with said casing.

6. A well bore packer adapted to be set in a casing in a well, comprising: an elongated body, normally retracted slip means on said body, expander means on said body for expanding said slip means, control means releasably connecting one of said slip means and expander means to said body and enabling expansion of said slip means by said expander means in response to longitudinal movement of said body following release of said control means, an abutment on said body, a resiliently deformable packing between said abutment and the other of said slip means and expander means to be resiliently deformed into sealing engagement with said body in response to further longitudinal movement of said body following expansion of said slip means, locking means for holding said body shifted with said packing deformed and said slip means engaged with the casing, release means releasably connecting said abutment to said body for permitting relaxation of said packing upon release of said release means, and means for connecting said body to a pipe string for running and retrieving said packer; said means for connecting said body to a pipe string including a tubular member telescopically engaged in said body, means forming a seal between said body and said tubular member, and means connecting said tubular member to said body and releasable by manipulation of said pipe string, said tubular member having an end projecting from said body, another abutment on said end, and means connecting said another abutment on said body and releasable to enable removal of said tubular member from said body.

7. A well bore packer adapted to be set in a casing in a well, comprising: an elongated body, normally retracted slip means on said body, expander means on said body for expanding said slip means, control means releasably connecting one of said slip means and expander means to said body and enabling expansion of said slip means by said expander means in response to longitudinal movement of said body following release of said control means, an abutment on said body, a resiliently deformable packing between said abutment and the other of said slip means and expander means to be resiliently deformed into sealing engagement with said body in response to further longitudinal movement of said body following expansion of said slip means, locking means for holding said body shifted with said packing deformed and said slip means engaged with the casing, release means releasably connecting said abutment to said body for permitting relaxation of said packing upon release of said release means, and means for connecting said body to a pipe string for running and retrieving said packer; said locking means being between said body and said expander means, said control means being between said slip means and said body, said release means releasably connecting said abutment to said body including frangible means responsive to pull on said tubing when said slip means hold said abutment against movement in said casing.

8. A well bore packer as defined in claim 7; said means for connecting said body to a pipe string including a tubular member telescopically engaged in said body, means forming a seal between said body and said tubular member, and means connecting said tubular member to said body and releasable by manipulation of said pipe string.

9. A well bore packer as defined in claim 7; said means for connecting said body to a pipe string including a tubular member telescopically engaged in said body, means forming a seal between said body and said tubular member, and means connecting said tubular member to said body and releasable by manipulation of said pipe string, said tubular member having an end projecting from said body, another abutment member on said end, and means connecting said another abutment on said body and releasable to enable retraction of said tubular member from said body.

10. A well packer adapted to be run into a well casing on a tubing string and set and released by tension of said tubing string, comprising: an elongated tubular packer body, a slick joint structure telescopically extending through said body; means forming a seal between said slick joint structure and said body; means releasably connecting said slick joint structure to said body and releasable to permit axial movement of said slick joint structure in said body; normally retracted expansible slip means on said body; control means releasably connecting said slip means to said body and releasable by manipulation of said slick joint structure; expander means on said body to expand said slip means; resilient packing means on said body engaged with said expander means; abutment means on said body engaged with said packing means for deforming said packing means and forcing said expander means towards said slip means in response to longitudinal movement of said slick joint and said body in one direction; body locking means to prevent movement of said body in the other direction; means for releasing said abutment means from said body allowing additional longitudinal movement of said body in said one direction; and means for releasing said slip means upon said additional longitudinal movement of said body.

11. A well packer as defined in claim 10; said body locking means including one way ratchet means between said expander and said body.

12. A well packer as defined in claim 10; said means for releasing said abutment being a frangible connection with said body.

13. A well packer as defined in claim 10; said body and said expander having frangible means to cause expansion of said slip means before deformation of said packing means.

14. A well packer as defined in claim 10; said slick joint structure having an end threaded thereon, and clutch means on said end and said body for removing said end responsive to rotation of said slick joint structure to allow removal of said slick joint structure from said body.

15. A well packer as defined in claim 10; said body locking means including one way ratchet means between said expander and said body, said means for releasing said abutment being a frangible connection with said body.

16. A well packer as defined in claim 10, said means for releasing said abutment being a frangible connection with said body, said body and said expander having frangible means to cause expansion of said slip means before deformation of said packing means.

17. In a well tool adapted to be set in a well casing: an elongated body having an upper end and a lower end; normally retracted expansible slip means on said body; control means releasably connecting said slip means to said body and releasable responsive to manipulation of said body; friction means engageable with the well casing for holding said slip means while said body moves upwardly; expander means on said body engageable with said slip means upon upward movement of said body to expand said slip means; resiliently deformable packing means on said body in force transmitting relation with said expander means and deformable into sealing engagement with the casing upon expansion of said slip means; locking means between said body and said expander for holding said body against downward movement; shearable means engaged with said body and said expander means and shearable to allow further upward movement of said body; and means on said body and said slip means engageable upon said further upward movement to pull said slip means upwardly with respect to said expander means to allow retraction of said slip means.

18. In a well tool as defined in claim 17; said locking means being one way ratchet means between said expander means and said body.

19. In a well tool as defined in claim 17; said friction means and said slip means being integral units having slip ends and friction ends, and including means pivotally supporting said units; and spring means normally biasing said friction ends outwardly and said slip ends inwardly.

20. In a well tool as defined in claim 19; said means to pull said slip means including a shoulder on said body engageable with said means pivotally supporting said units.

* * * * *